US006521852B1

(12) United States Patent
Ni

(10) Patent No.: US 6,521,852 B1
(45) Date of Patent: Feb. 18, 2003

(54) PUSHBUTTON SWITCH

(75) Inventor: Yu-Ting Ni, Hsin-Tien (TW)

(73) Assignee: Shin Jiuh Corp., Taipei Hsien (TW)

( * ) Notice: Subject to any disclaimer, the term of this patent is extended or adjusted under 35 U.S.C. 154(b) by 0 days.

(21) Appl. No.: 10/138,380

(22) Filed: May 6, 2002

(51) Int. Cl.[7] ..... H01H 13/14
(52) U.S. Cl. ..... 200/520; 200/534; 200/511
(58) Field of Search ..... 200/520, 534, 200/535, 505, 510, 511, 406, 239, 16 R, 16 A, 341, 345, 243, 521

(56) References Cited

U.S. PATENT DOCUMENTS 3,590,331 A * 6/1971 Kirsch ..... 200/535
4,177,367 A * 12/1979 Tirone et al. ..... 200/535
4,385,218 A * 5/1983 Nishida ..... 200/1 B
4,463,233 A * 7/1984 Tanabe ..... 200/345
4,843,197 A * 6/1989 Kojima et al. ..... 200/302.2
4,894,498 A * 1/1990 Kagwa et al. ..... 200/284
5,199,556 A * 4/1993 Lee ..... 200/345
5,345,051 A * 9/1994 Miike ..... 200/341
5,726,400 A * 3/1998 Masuda ..... 200/1 R
5,895,901 A * 4/1999 Watanabe et al. ..... 200/530
6,049,047 A * 4/2000 Miyashima et al. ..... 200/16 A
6,271,487 B1 * 8/2001 Domzalski et al. ..... 200/1 B
6,441,331 B1 * 8/2002 Nimberger et al. ..... 200/520

* cited by examiner

*Primary Examiner*—Lincoln Donovan
*Assistant Examiner*—Kyung S. Lee
(74) *Attorney, Agent, or Firm*—Birch, Stewart, Kolasch & Birch, LLP

(57) ABSTRACT

An improved pushbutton switch includes an elastic element located in a body. The elastic element is made of metal and bent to form an action which has an inner diameter and two free ends to form respectively two support arms. The support arms are located in the body. When the elastic element is subject to an external pressing force, the inner diameter of the action section contracts slightly and the support arms are pressed downwards to connect two terminals of the pushbutton switch to establish electric connection to deliver signal output. When the external pressing force is released from a press element, the inherent elastic force of the elastic element pushes the press element back to its original location.

3 Claims, 5 Drawing Sheets

PUSHBUTTON SWITCH

FIELD OF THE INVENTION

The present invention relates to an improved pushbutton switch and particularly a pushbutton switch that consists of simplified components for saving assembly time, labors and costs.

BACKGROUND OF THE INVENTION

Applicant has previously submitted a patent application at Ser. No. 09/740997 entitled: "Improved pushbutton switch" for channeling signals or delivering output signals. It includes a body with two terminals located thereon, a first elastic element housed in the body for operating, a pressing element located in the body above the first elastic element, and a seal element to cover the body. When the pressing element is depressed by an external force, a second elastic element is driven to press the first elastic element. The first elastic element is pressed downwards to contact the two terminals to establish electric connection and output electric signals. When the press element is free from the external pressing force, the inherent elastic forces of the first and the second elastic elements push the press element back to its original location.

While the "Improved pushbutton switch" set forth above has a simpler construction than conventional pushbutton switches and has less number of contacts and can greatly reduce impedance, and also enables signals to pass through without fading, it requires two elastic elements. As a result, production cost is higher, and assembly time and efforts are greater. Moreover, with two elastic elements located in an operating space, the downward moving area for the second elastic element is limited when depressed, and tends to cause incomplete contact on the two terminals. Signal output could be interrupted and result in decreasing operation effectiveness.

SUMMARY OF THE INVENTION

The primary object of the invention is to resolve the foregoing disadvantages. The pushbutton of the invention requires only one elastic element. Thus assembly time and efforts can be reduced, and production cost also becomes lower.

Another object of the invention is to have one terminal running through a hole in the body and being located in an operating space while another terminal being located in a wedge notch to achieve secured signal channeling and output.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
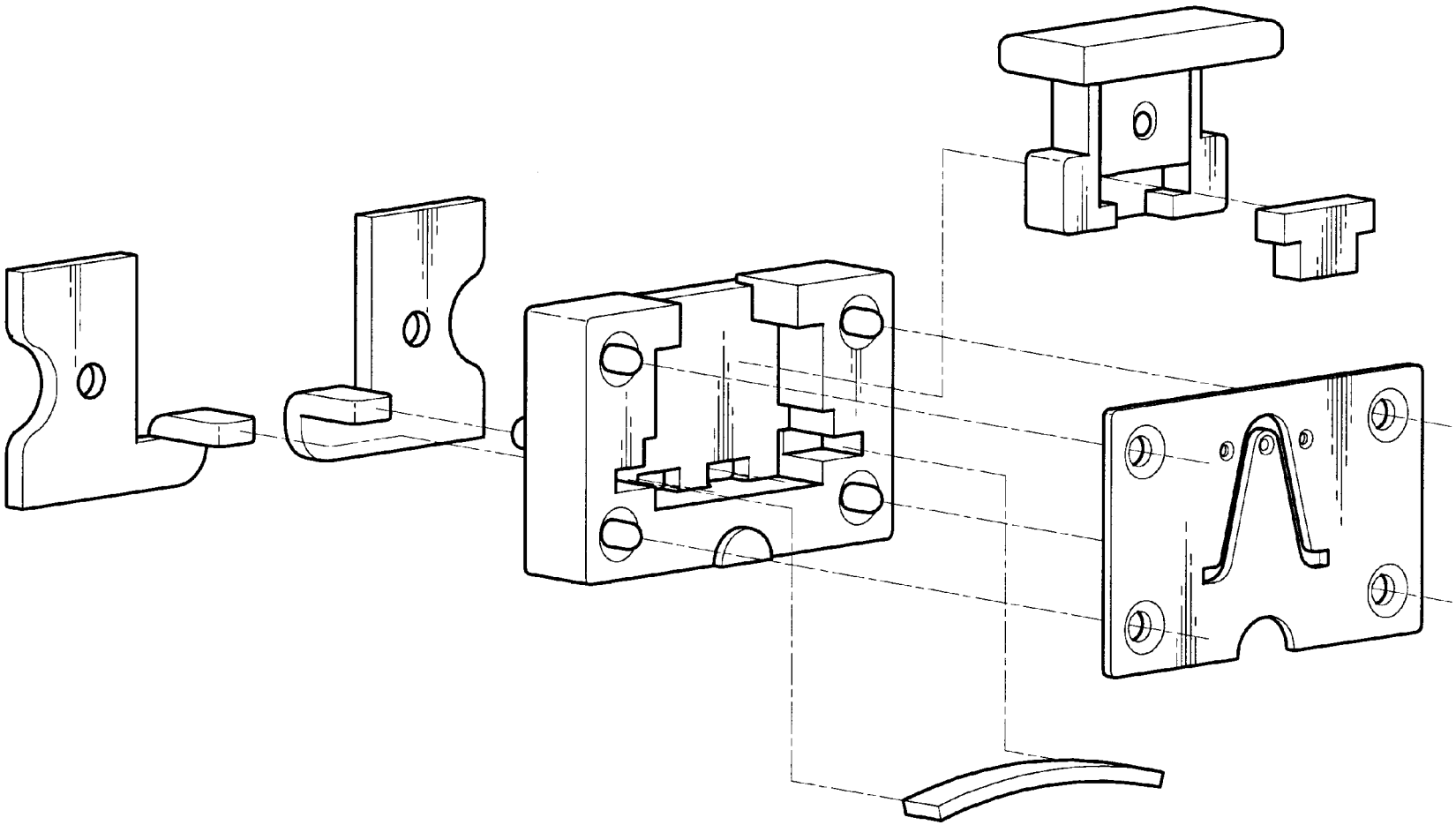
Fig.1 PRIOR ART
FIG. 1 is an exploded view of a conventional pushbutton switch.
Figure 2:
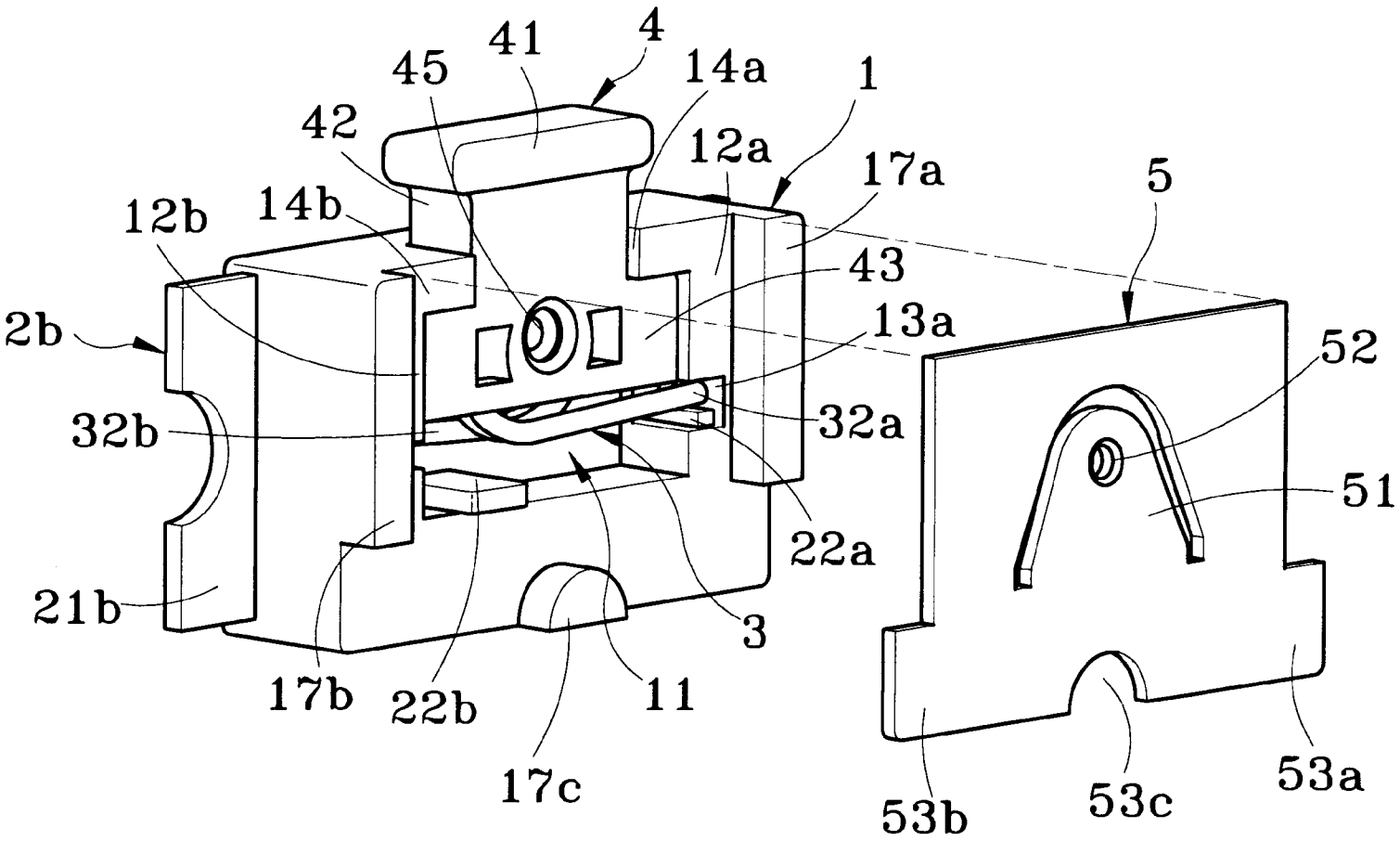
FIG. 2 is a partial exploded view of the invention.
Figure 3:
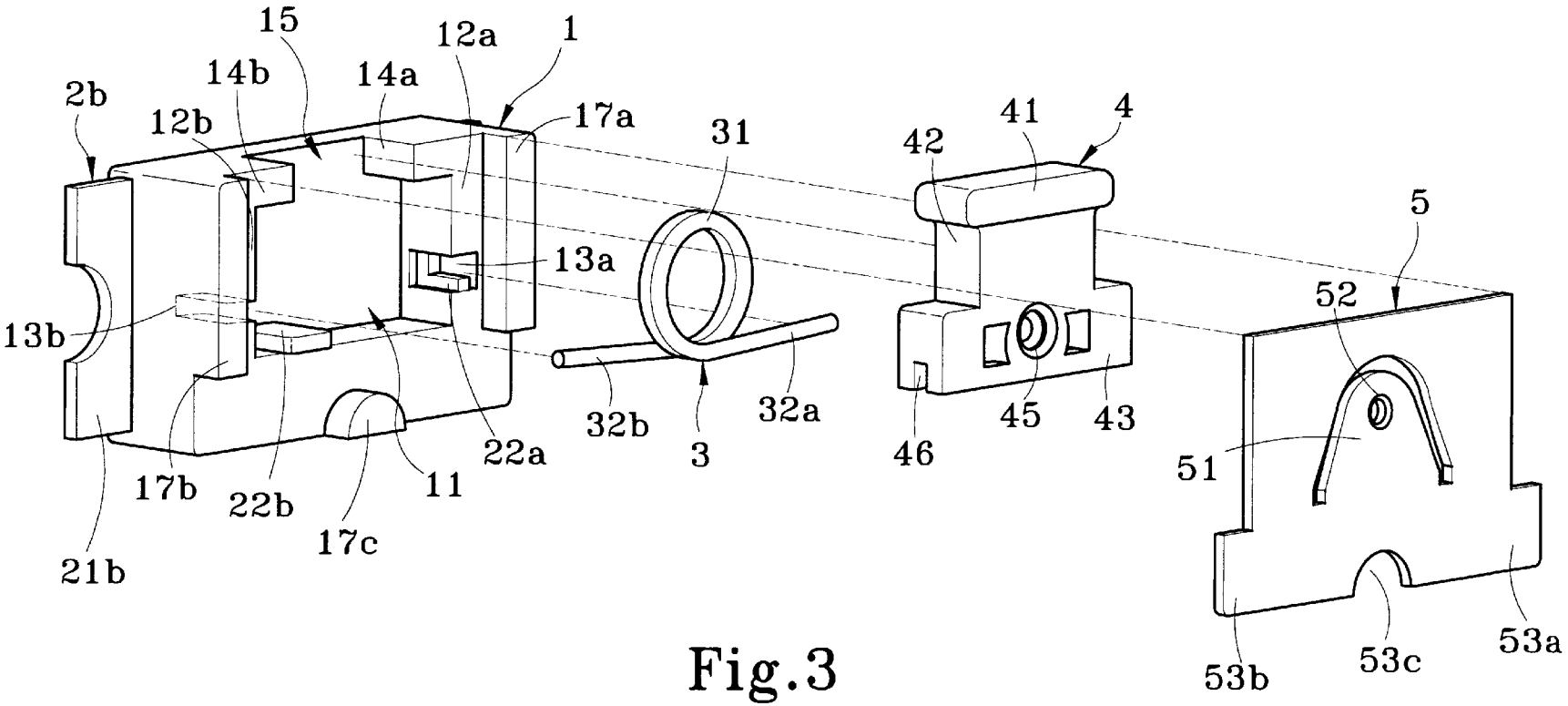
FIG. 3 is an exploded view of the invention.
Figure 4:
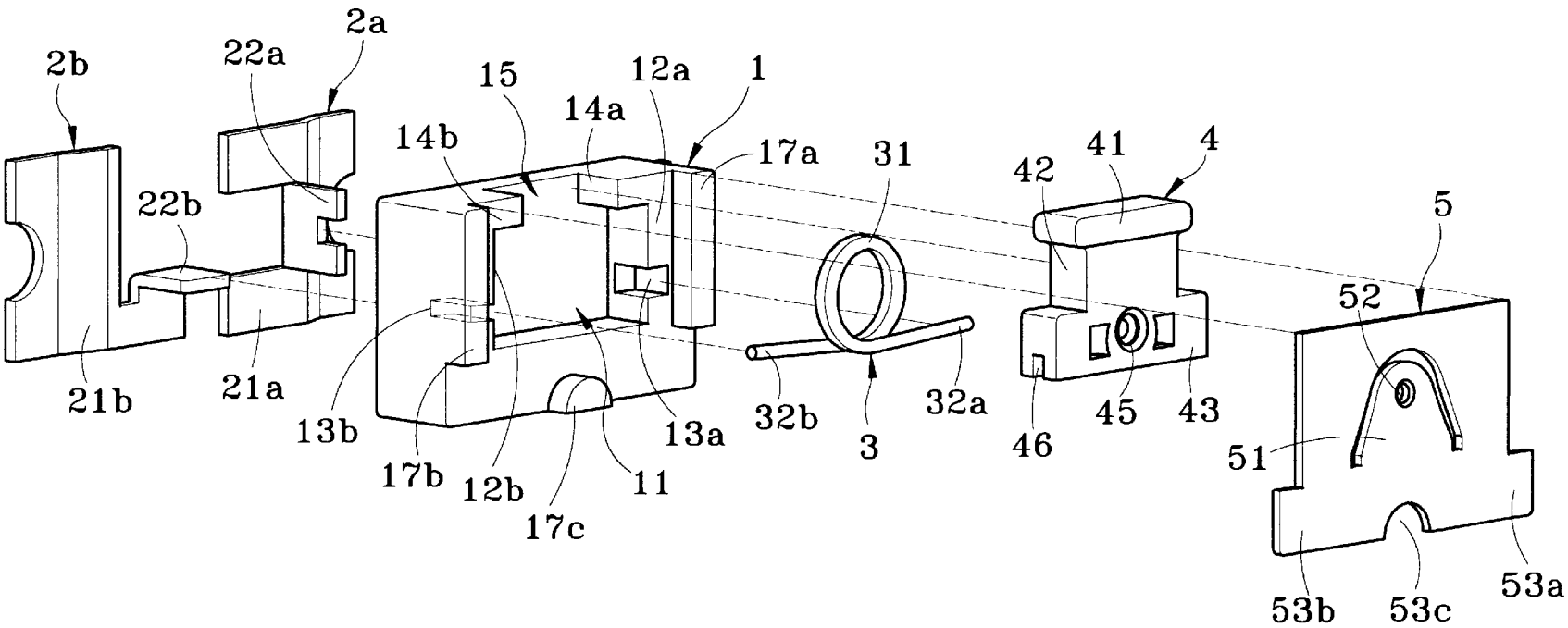
FIG. 4 is an exploded view of the invention, with two terminals detached

Referring to FIGS. 2, 3 and 4, the pushbutton switch of the invention includes a body 1, a first terminal 2*a* and a second terminal 2*b* located in the body 1, an elastic element 3 housed in the body 1 for operating therein, a press element 4 located in the body 1 above the elastic element 3, and a cover plate 5 located on the front side of the body 1 to seal the body. The pushbutton switch thus constructed may be used for channeling signals or delivering signal output.

The body 1 has an operating space 11 formed therein. On two sides of the operating space 11, there are a first thick section 12*a* and a second thick section 12*b*. The first thick section 12*a* and the second thick section 12*b* have respectively a first wedge notch 13*a* and a second wedge notch 13*b* opposing to each other and communicating with the operating space 11. The first thick section 12*a* and the second thick section 12*b* have respectively an upper end forming a first retain flange 14*a* and a second retain flange 14*b* extending towards each other to form an opening 15 therebetween to communicate with the operating space 11. On two outer sides of the first thick section 12*a* and the second thick section 12*b*, there are respectively a first anchor section 17*a* and a second anchor section 17*b* symmetrical to each other. On the lower side of the body 1, there is a third anchor section 17*c*.

The first terminal 2*a* and the second terminal 2*b* have respectively a first blade section 21*a* and a second blade section 21*b*. The first blade section 21*a* has one end forming a first contact 22*a* and extending into the first wedge notch 13*a*. The second blade section 21*b* has one end forming a second contact 22*b* and extending into the operation space 11. The two terminals 2*a* and 2*b* are embedded in the body 1 through an integrated injection forming process.

The elastic element 3 is made of metal and is bent to form an action section 31 which has an inner diameter and two free ends extending to form a first support arm 32*a* and a second support arm 32*b*. The first support arm 32*a* and the second support arm 32*b* are wedged respectively in the first wedge notch 13*a* and the second wedge notch 13*b*. When the elastic element 3 is subject to compression, the inner diameter of the action section 31 will contract slightly. As a result, the support arms 32*a* and 32*b* will be pressed downwards to connect the contacts 22*a* and 22*b*.

The press element 4 has a press top 41, a neck 42 connecting to the press top 42 and movable in the opening 15, and a press section 43 connecting to the neck 42. The press section 43 has a housing chamber 44 formed therein to hold the action section 31 of the elastic element 3, and a trough 46 formed on a lower end corresponding to the two supporting arms 32*a* and 32*b*. On one lateral side of the neck 42 or the press section 43, there is a cavity 45 to generate a clicking sense when the press element 4 is depressed downwards.

The cover plate 5 has an elastic flap 51 which has a bulged spot 52 located on one end engageable with the cavity 45 to generate the clicking sense when the press element 4 is moved downwards and slid against the elastic flap 51. On the peripheral sides of the elastic flap 51, there are a first coupling section 53*a* and a second coupling section 53*b* to couple respectively with the first anchor section 17*a* and the second anchor section 17*b*, and a third coupling section 53*c* to couple with the third anchor section 17*c*.

Figure 5:
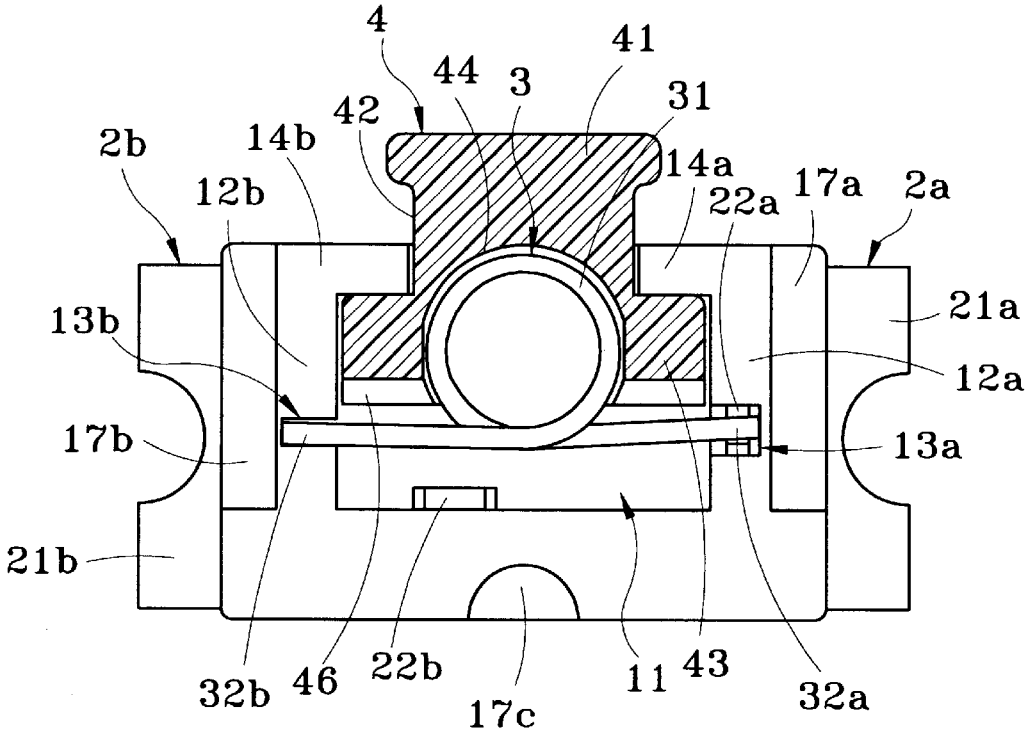
FIG. 5 is a front view of the invention, with the cover plate removed.
Figure 6:
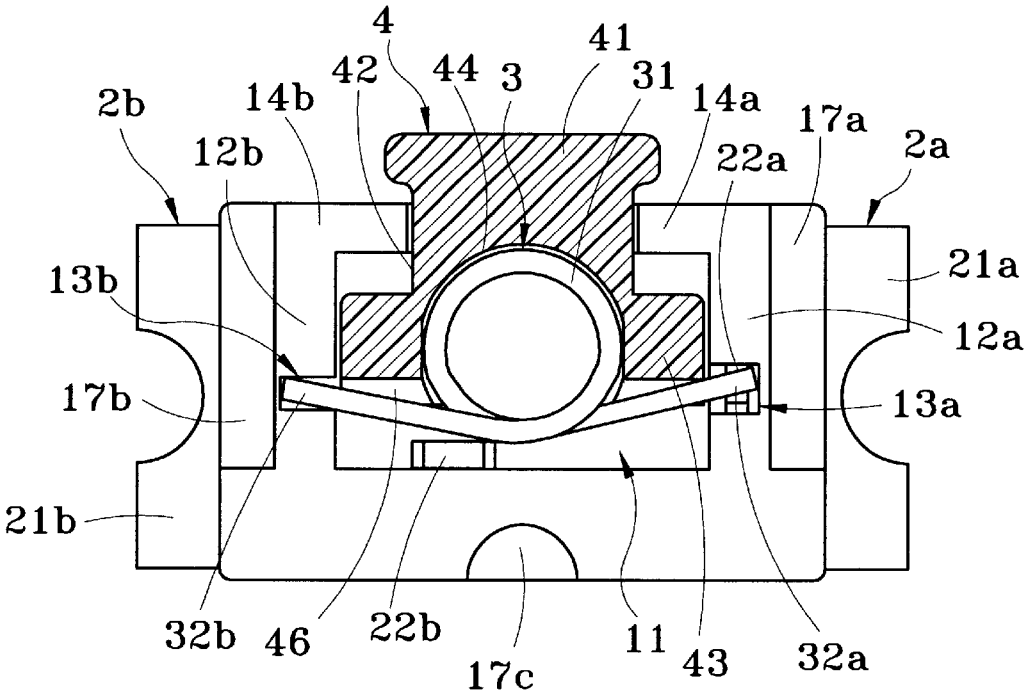
FIG. 6 is a schematic of the invention according to FIG. 5, showing an operating condition.

Refer to FIGS. 5 and 6 for the invention in an assembly and operating condition. As shown in the drawings, after the terminals 2*a* and 2*b*, press element 4, elastic element 3 and cover plate 5 are assembled in the body 1, and when the press top 41 of the press element 4 is subject to an external pressing force, the neck 42 is moved downwards in the opening 15. When the press element 4 is depressed downwards, the inner diameter of the action section 31 of the elastic element 3 is contracted slightly, and the support arms 32*a* and 32*b* generate a downward movement to connect respectively the contacts 22*a* and 22*b* of the terminals 2*a* and 2*b* to establish electric connection, therefore signals can be transmitted and output. When the external pressing force is released from the press top 41, the inherent elastic force of the elastic element 3 pushes the press element 4 back to its original location.

The elastic element 3 is made of metal and bent into a desired shape. Thus the structure of the invention is simpler than the conventional techniques that require two elastic elements. Assembly time, processes and cost are also lower. Moreover, as the first support arm 32*a* of the elastic element 3 and the first terminal 2*a* are located in the first wedge notch 13*a*, when the elastic element 3 is deformed under force, the first support arm 32*a* connects the first contact 22*a* of the first terminal 2*a*, while the second support arm 32*b* is depressed downwards to connect the second contact 22*b* of the second terminal 2*b*. Thus electric connection between the first terminal 2*a* and the second terminal 2*b* can be securely established to generate accurate signal output, and effectively overcome the poor contact that might otherwise incur to the conventional pushbutton switches.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An improved pushbutton switch, comprising:

a body having an operating space formed therein, a first thick section and a second thick section located on two sides of the operating space, and a first terminal and a second terminal located in the body, the first thick section and the second thick section having respectively a first wedge notch and a second wedge notch opposing to each other and communicating with the operating space, the first thick section and the second thick section having respectively one end forming an opening therebetween to communicate with the operating space, the first terminal and the second terminal having respectively a first blade section and a second blade section which have respectively one side extending into the body to form a first contact and a second contact;

a press element having a press top, a neck connecting to the press top and movable in the opening, and a press section connecting to the neck, the press section having a housing chamber and a trough; and an elastic element having an action section housed in the housing chamber, the action section having an inner diameter and two free ends extending to form a first support arm and a second support arm corresponding to the trough and extending respectively into the first wedge notch and the second wedge notch;

wherein the neck is moved downwards through the opening when the press top is subject to an external pressing force to press the elastic element and cause the inner diameter of action section to contract such that the first support arm and the second support arm are pressed downwards to connect respectively the first terminal and the second terminal to establish electric connection to output signal;

wherein the elastic element has inherent elastic force to push the press element back to its original location when the external pressing force is released from the press top.

2. The improved pushbutton switch of claim 1, wherein one of the terminals extends into the operating space and another one of the terminal extends into one of the wedge notches.

3. The improved pushbutton switch of claim 1, wherein the elastic element is made of metal and bent to form the action section.

* * * * *